US006409475B1

(12) United States Patent
Ho

(10) Patent No.: US 6,409,475 B1
(45) Date of Patent: Jun. 25, 2002

(54) COMPUTER COOLING FAN

(76) Inventor: Chan Hsiang Ho, P.O. Box 24-108, Taipei (TW)

( * ) Notice: Subject to any disclaimer, the term of this patent is extended or adjusted under 35 U.S.C. 154(b) by 0 days.

(21) Appl. No.: 09/824,913

(22) Filed: Apr. 4, 2001

(51) Int. Cl.[7] ..... F04D 29/64
(52) U.S. Cl. ..... 416/63; 416/246; 248/314
(58) Field of Search ..... 416/63, 244 R, 416/246, 247 R; 248/314, 309.1

(56) References Cited

U.S. PATENT DOCUMENTS 751,485 A * 2/1904 Eck ..... 248/663
1,329,816 A * 2/1920 Winslow ..... 248/126
4,219,178 A * 8/1980 Assion ..... 248/314
4,461,439 A * 7/1984 Rose ..... 248/288.31

* cited by examiner

*Primary Examiner*—F. Daniel Lopez
*Assistant Examiner*—Richard Edgar

(57) ABSTRACT computer cooling fan includes a fan and a plastic fan holder fixedly fastened to the computer mainframe, monitor, computer table, or the like, and adapted to hold the fan, the fan having a fan stand capable of supporting the fan on a flat surface positively, a fan blade, and a fan head unit pivoted to the fan stand and turned to move the fan blade to the desired angle and controlled by an on/off switch at the fan stand to rotate the fan blade, the fan holder having a receptacle adapted to hold the fan stand of the fan.

2 Claims, 3 Drawing Sheets

COMPUTER COOLING FAN

BACKGROUND OF THE INVENTION

The present invention relates to electric fans and, more particularly, to a computer cooling fan adapted to cool the temperature of the computer working environment. The fan can be independently used and put on the table top or a flat surface and operated to cause currents of air in the desired direction. Alternatively, the fan can be used with a fan holder, which is fixedly fastened to the computer mainframe, the computer monitor, the computer table, or any of a variety of objects at the desired location.

When using a computer system, the computer mainframe and the computer monitor produce much heat during the operation. Poor ventilation may affect the operation of the computer system, causing the computer system to shut down due to excessively high temperature. Therefore, good ventilation is important when using a computer system.

SUMMARY OF THE INVENTION

The present invention has been accomplished under the circumstances in view. It is one object of the present invention to provide a computer cooling fan, which can be used with a computer system and controlled to cause currents of air to improve ventilation of the working environment. It is another object of the present invention to provide a computer cooling fan, which can be used independently and positively positioned on a flat surface. According to one aspect of the present invention, the computer cooling fan comprises a fan, and a plastic fan holder fixedly fastened to the computer mainframe, monitor, computer table, or the like, and adapted to hold the fan. The fan comprises a fan stand capable of supporting the fan on a flat surface positively, a fan blade, and a fan head unit controlled by an on/off switch at the fan stand to rotate the fan blade. The fan holder comprises a receptacle adapted to hold the fan stand of the fan. According to another aspect of the present invention, the fan head unit is pivoted to the fan stand by a ball socket joint so that the fan blade can be turned with the fan head unit relative to the fan stand to the desired angle.

DETAILED DESCRIPTION OF THE PREFERRED EMBODIMENT

Figure 1:
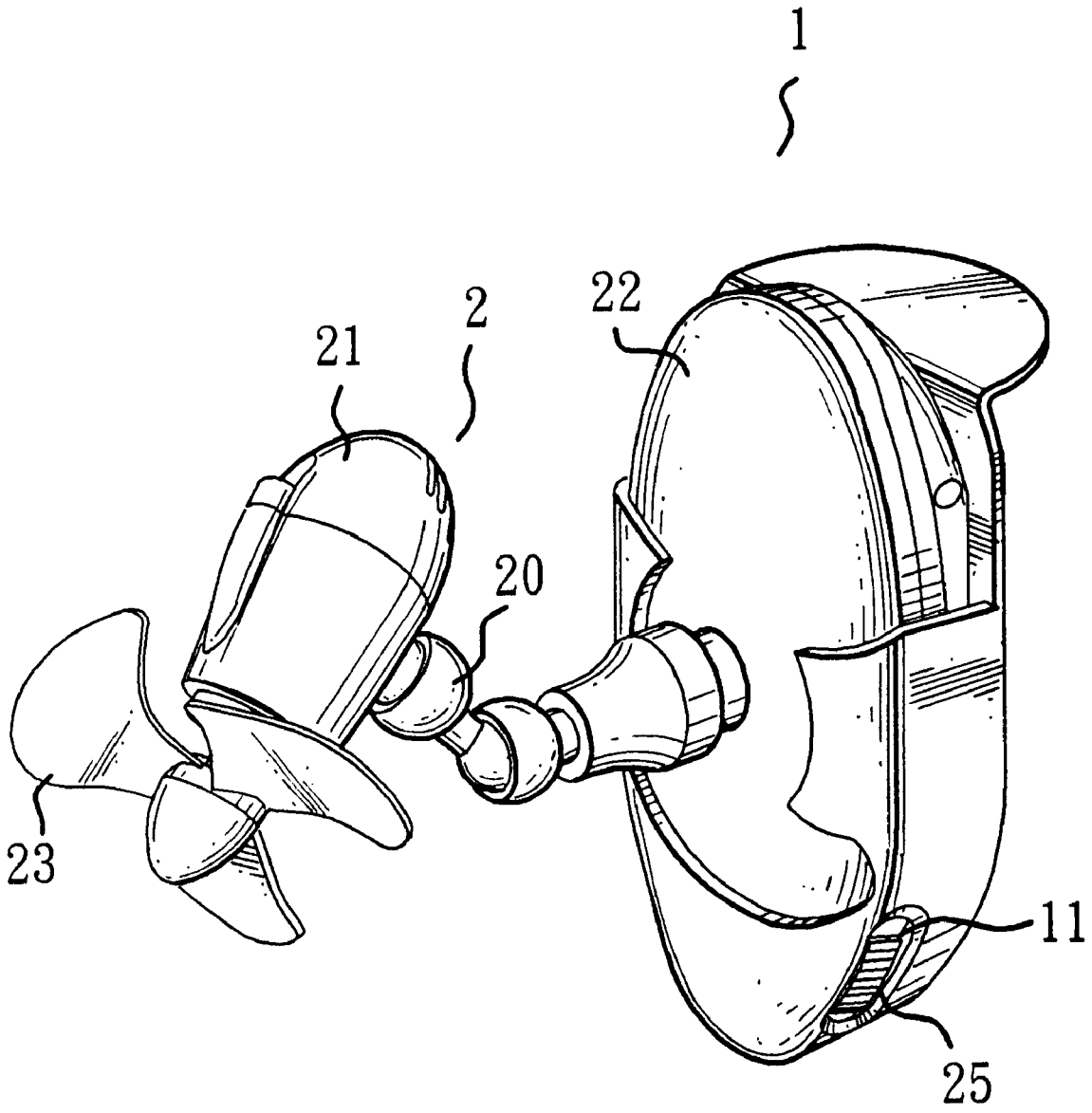
FIG. 1 is a perspective view of a computer cooling fan according to the present invention showing the fan held in the fan holder.

Referring to FIGS. from 1 through 4, a computer cooling fan in accordance with the present invention is generally comprised of a fan holder 1. and a fan 2. The fan holder 1 is injection-molded from plastics, comprising a receptacle 10 adapted to hold the fan, and two through holes 11 and 12 through two opposite sidewalls of the receptacle 10. The fan holder 1 can be fixedly fastened to the peripheral wall of an object, for example, the computer mainframe, the monitor, or the computer table by screws, adhesive, or any of a variety of fastening devices. The fan 2 comprises a fan head unit 21, a fan stand 22, and a fan blade 23. The stand comprises a battery power supply unit (not shown) disposed on the inside, a power jack 24, and an on/off switch 25. The fan head unit 21 is pivoted to the fan stand 22 by a ball socket joint 20 and controlled by the switch 25 to rotate the fan blade 23. The fan stand 22 can be inserted into the receptacle 10 of the fan holder 1. After insertion of the fan stand 22 into the receptacle 10 of the fan holder 1, the power jack 24 and the on/off switch 25 are respectively aimed at the through holes 12 and 11 of the receptacle 10 of the fan holder 1 for operation by hand.

Figure 2:
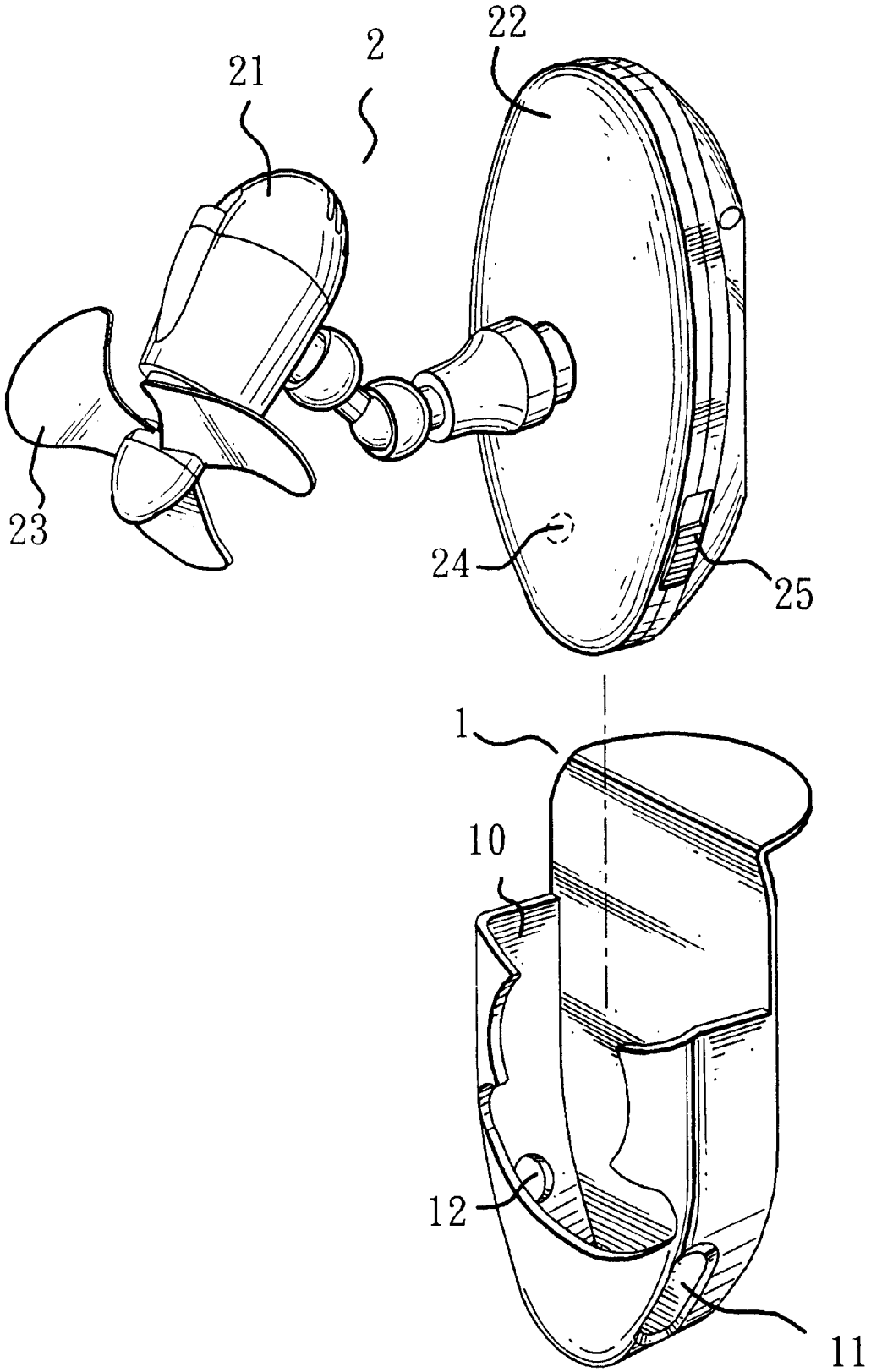
FIG. 2 is an exploded view of the present invention, showing the fan removed from the fan holder.
Figure 3:
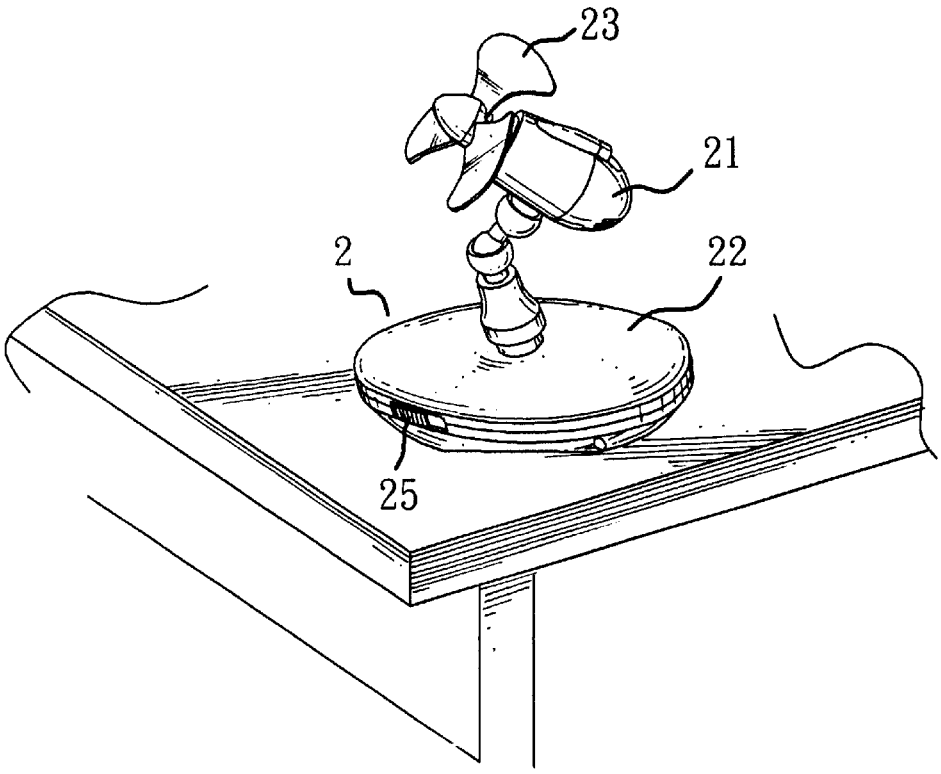
FIG. 3 is an applied view of the present invention showing the fan positioned on the table top.

Referring to FIGS. 2 and 3 again, after removal of the fan 2 from the fan holder 1, the fan 2 can be used independently and put on the table top or a flat surface. Because the stand 22 has a flat and broad bottom face, the fan 2 can be stably positioned on a flat surface. By means of the ball socket joint 20, the fan blade 23 can be turned with the fan head unit 21 relative to the stand 22 to the desired angle. When switching on the on/off switch 25, the fan blade 23 is rotated to cause currents of air for cooling.

Figure 4:
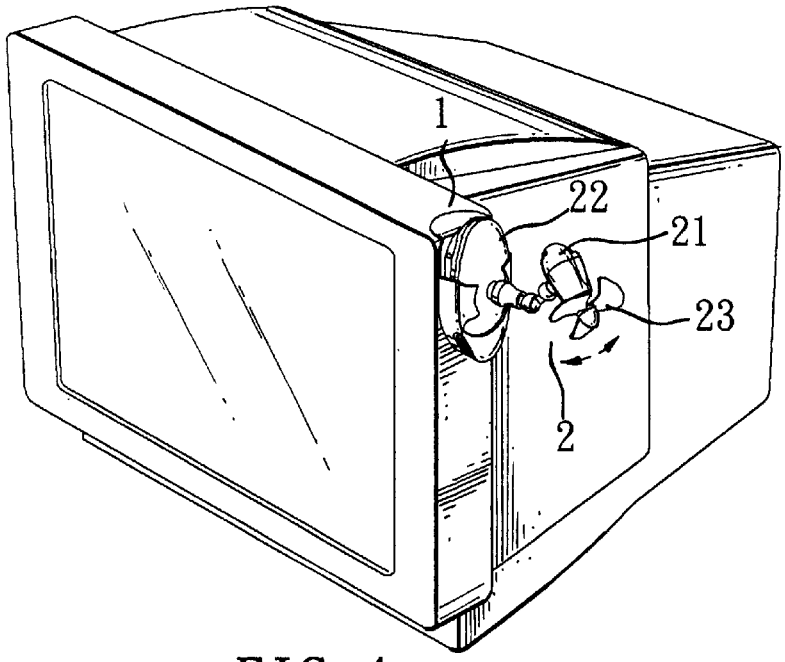
FIG. 4 is another applied view of the present invention showing the fan holder fixedly fastened to the peripheral wall of a computer monitor and the fan set in the fan holder.

Referring to FIGS. 2 and 4 again, by means of inserting the fan stand 22 into the receptacle 10 of the fan holder 1, the fan 2 is supported on the object (For example, the computer monitor) to which the fan holder 1 is fastened. When switching on the on/off switch 25, the fan blade 23 is rotated to cause currents of air for cooling.

A prototype of computer cooling fan has been constructed with the features of FIGS. 1~4. The computer cooling fan functions smoothly to provide all of the features discussed earlier.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. A computer cooling fan comprising:

a fan, said fan comprising a stand, a fan blade, a fan head unit supported on said stand and controlled to rotate said fan blade, and power supply means mounted in said stand and controlled to provide electricity to said fan head unit; and a fan holder injection-molded from plastics and fixedly fastened to an object for supporting said fan on said object;

wherein said fan comprises a ball socket joint coupled between said fan stand and said fan head unit for enabling said fan blade to be turned with said fan head unit relative to said fan stand to the desired angle; said fan holder comprises a receptacle adapted to hold the fan stand of said fan.

2. The computer cooling fan of claim 1 wherein said receptacle of said fan holder comprises two through holes disposed at two sides, and the fan stand of said fan comprises a power jack and an on/off switch respectively disposed at two sides, said power jack and said on/off switch being respectively aimed at the through holes of said receptacle of said fan holder after insertion of said fan stand into said receptacle of said fan holder.

* * * * *